United States Patent [19]

Anderson, III et al.

[11] Patent Number: 4,651,503

[45] Date of Patent: Mar. 24, 1987

[54] METHOD AND APPARATUS FOR FORMING AND PACKAGING UNSTABLE PRODUCTS

[75] Inventors: John Anderson, III, Wilmington; David R. Knowlton, Ipswich, both of Mass.

[73] Assignee: The Gillette Company, Boston, Mass.

[21] Appl. No.: 620,220

[22] Filed: Jun. 13, 1984

[51] Int. Cl.[4] ..... B65B 63/08

[52] U.S. Cl. ..... 53/440; 53/474; 141/2

[58] Field of Search ..... 53/402, 428, 431, 440, 53/470, 474; 141/2, 3, 5, 105, 107

[56] References Cited

U.S. PATENT DOCUMENTS

| | | | |
|---|---|---|---|
| 2,963,834 | 12/1960 | Stanley et al. | 53/470 |
| 3,013,591 | 12/1961 | Stanley et al. . | |
| 3,583,446 | 6/1971 | Rush | 141/105 |
| 3,618,171 | 11/1971 | Zecher . | |
| 3,977,151 | 8/1976 | Reever et al. | 53/470 X |
| 4,103,722 | 8/1978 | Zollinger | 141/107 X |
| 4,141,470 | 2/1979 | Schulte et al. | 141/107 X |
| 4,334,783 | 6/1982 | Suzaka . | |
| 4,405,489 | 9/1983 | Sisbarro . | |
| 4,452,917 | 6/1984 | Proska et al. | 141/107 X |

OTHER PUBLICATIONS

Publication 9/70—Kartridg Pak publication—"Manual for Undercap Gasser 939". pp. 13–26.

*Primary Examiner*—John Sipos
*Assistant Examiner*—Steven P. Weihrouch
*Attorney, Agent, or Firm*—Mandel E. Slater

[57] ABSTRACT

A method and apparatus for forming and packaging, within a suitable container for the dispensing thereof, an unstable product produced by intimately mixing at least first and second ingredients, the resulting unstable product remaining stable following the mixing of the ingredients for a relatively short period of time under normal ambient conditions, the method including the steps of providing streams of the ingredients, intimately mixing the ingredients in a filling head, ejecting the mixture from the filling head into a container, and sealing the container prior to the elapse of the relatively short period of time. The apparatus generally includes a first metering device for receiving a pressurized supply of the first ingredient and for producing therefrom predetermined dosages thereof, a second metering device for receiving a pressurized supply of the second ingredient and for producing therefrom predetermined dosages thereof, a filling head for simultaneously receiving the predetermined dosages of first and second ingredients, for intimately mixing the dosages and for ejecting the resultant mixture into a container, and actuation apparatus for simultaneously actuating the first and second metering devices when the container is moved to a filling position relative to the filling head.

10 Claims, 7 Drawing Figures

45

50
50
32
49
AIR LIMIT VALVE
54
42
44
43
34
36
46
48
PRESSURIZATION FOAMING AGENT
AIR CYLINDER
56
51
47
38
AIR LIMIT VALVE
55
AIR CYLINDER
52
40
4-WAYVALVE
PILOT AIR FROM LIMIT VALVES
53
AIR
C

METHOD AND APPARATUS FOR FORMING AND PACKAGING UNSTABLE PRODUCTS

BACKGROUND OF THE INVENTION

1. Field of the Invention

In general, the present invention relates to a method and apparatus for forming an unstable product produced by an intimate mixing of ingredients, the resultant unstable product remaining stable following the mixing for a relatively short period of time under normal ambient conditions, and for packaging the unstable product within a suitable container for the dispensing thereof.

More particularly, the present invention relates to a method and apparatus for the forming and packaging of delayed foaming gels within suitable containers.

2. Description of the Prior Art

As used herein, the term "delayed foaming gel" denotes a viscous emulsion of at least an aqueous surfactant (for example, water and a soap or detergent) and a volatile foaming agent (e.g., a volatile hydrocarbon such as isopentane, isobutane, a mixture of such hydrocarbons, or the like, for example, fluorocarbons) wherein the volatile foaming agent is included in the internal phase of the emulsion. Various skin conditioners, lubricants, oils, perfumes, dyes, perservatives, etc. can also be included.

Such gels find use in the personal care field. One such known product is a delayed foaming shaving gel which is expelled from an aerosol container in the form of a gel, but which thereafter converts to a foam upon vaporization of the foaming agent. However, such delayed foaming gels are seen to have other applications, e.g., shampoos and other cleansing products, skin lotions, so-called "mousses", etc., and the present invention is not to be limited to delayed foaming shaving gels.

To prevent premature foaming, such delayed foaming gels are customarily packaged such that there is no appreciable air space for the gel to foam into prior to being dispensed from the container. That is, the gel should completely fill the container and there should be, to the gretest extent possible, no headspace or enclosed void spaces into which the gel can foam.

Quite often, so-called "barrier" aerosol containers are used to merchandise such gels, wherein the gel is densely packed into a collapsible bag suspended within an aerosol can. A propellant contained between the "barrier" and the outer wall of the can serves to dispense the gel by collapsing the bag when the valve is opened. However, other containers such as pump dispensers could be used for the merchanidising and dispensing of such gels, and the present invention is not to be limited to the use of so-called "barrier"aerosols.

If an aqueous surfactant along with any added emulsifiers, oils, perfumes, etc. (herein collectively referred to as "concentrate") is intimately mixed with an appropriate foaming agent such that the foaming agent enters and becomes emulsified in the internal phase, a delayed foaming gel will be produced. However, packaging of such a gel raises considerable problems. Due to its high viscosity, it is difficult to densely pack such a gel into a suitable container without producing void spaces which allow premature foaming.

One known approach to packaging similar gels is to "spin fill" the containers. The containers are rotated rapidly around their longitudinal axes as the product is introduced. The resultant centrifugal forces tend to fully fill the containers without leaving voids. Clearly, however, such a technique requires intricate and quite expensive packaging machinery.

Another process is shown in U.S. Pat. No. 4,405,489, wherein an aqueous soap ingredient and a post-foaming agent are mixed and the mixture is then placed in a pressurized and refrigerated holding tank for a time sufficient to form a gel prior to being introduced into suitable containers. This patent teaches the use of pressurization and refrigeration to maintain the already formed gel in a condition capable of continuously flowing through the system for introduction into the container.

Conventional aerosol foams do not present the particular handling and packaging considerations outlined above. Such conventional aerosol foams are usually packaged in conventional aerosol containers by first partially filling the container with a soap solution and thereafter charging the container by injecting a suitable propellant through the valve of the container.

U.S. Pat. No. 3,013,591 discloses a particularly notable method and apparatus for charging conventional aerosol containers already containing product with a propellant through the container valve. Gassing devices incorporating the teachings of this patent are manufactured and sold by The Kartdrig Pak Co. of Davenport, Iowa, for example their Model No. 939. The construction and operation of such devices are also shown in various Kartridg Pak publications, such as their "Manual for Undercap Gasser 939".

Inasmuch as the present inventors have utilized certain principles taught in this patent in the present invention, U.S. Pat. No. 3,013,591, which is discussed more fully below, is hereby expressly incorporated by reference.

SUMMARY OF THE INVENTION

In general, the invention features a process for forming and packaging, within a suitable container for the dispensing thereof, an unstable product produced by intimately mixing at least first and second ingredients, the resulting unstable product remaining stable following the mixing of the ingredients for a relatively short period of time under normal ambient comditions. The method includes the steps of providing streams of the first and second ingredients, intimately mixing the ingredients in a filling head, ejecting the resultant mixture from the filling head into a container, and sealing the container prior to the lapse of the relatively short period of time.

In a preferred embodiment, the unstable product is a delayed foaming gel, the first ingredient is an aqueous surfactant and the second ingredient is a foaming agent. Following the sealing of the container, the container is equilibriated to normal ambient temperature thereby causing the mixture to form the delayed foaming gel in the container.

The apparatus includes first and second metering devices for receiving pressurized supplies of the first and second ingredients and for producing therefrom predetermined dosages of the first and second ingredients, a filling head for simultaneously receiving the predetermined dosages of the ingredients for intimately mixing the dosages and for ejecting the resulting mixture into a container, and actuation apparatus for simultaneously actuating the first and second metering devices when the container is moved to a filling position relative to the filling head. Preferably, the first metering device is a pressure actuated metering cylinder. An apparatus is provided for determining and varying predetermined dosages of the first and second ingredients.

The filling head generally includes a static mixer disposed within a throughgoing channel for intimately mixing the first and second ingredients, metering means for introducing metered dosages of the first and second ingredients into the throughgoing channel, a first valve located upstream of the static mixer for controlling the flow of the first ingredient into the channel, and a second valve located downstream of the static mixer for selectively opening the downstream end of the channel in response to the correct positioning of a container to be filled with the mixture. Preferably, the filling head also includes a shearing device located immediately downstream of the static mixer, a deceleration device disposed downstream of the second valve for decelerating the flow rate of the mixture prior to its flow into a container, and sequencing apparatus for opening the first valve prior to opening the second valve.

These and other aspects of the present invention will now be explained and described by way of a particular preferred embodiment, reference being had to the accompanying drawings wherein:

DESCRIPTION OF THE PREFERRED EMBODIMENT

Figure 1:
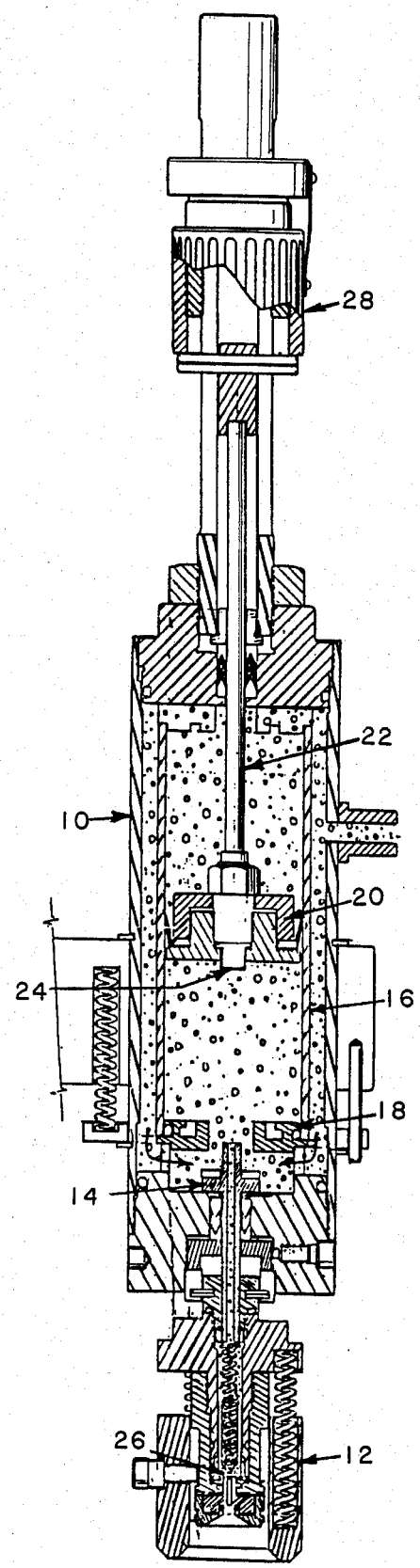
FIG. 1 PRIOR ART
FIG. 1 is a cross-sectional elevational view of a known pressure actuated aerosol container gassing device during a recovery stroke.
Figure 2:
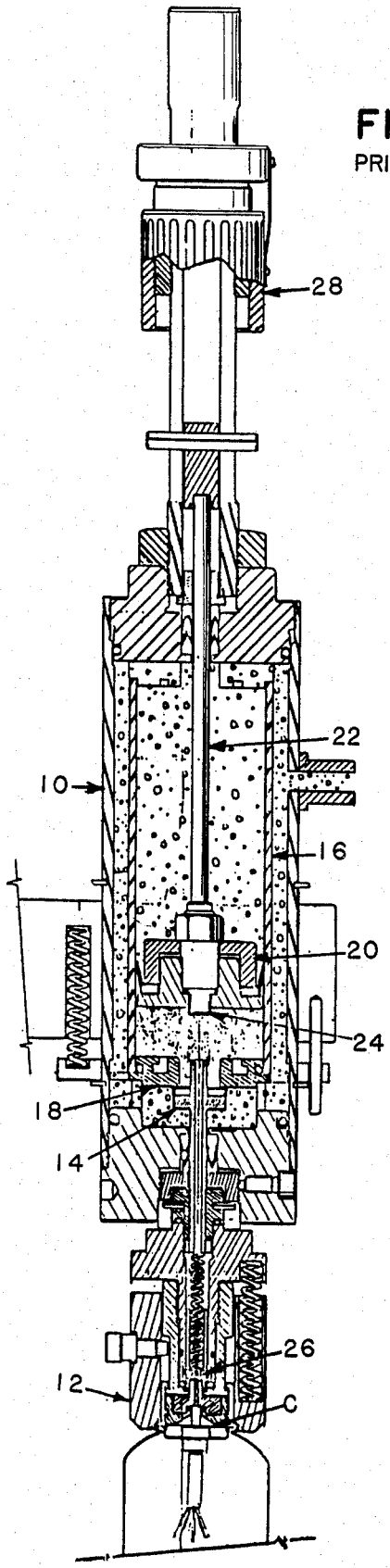
FIG. 2 PRIOR ART
FIG. 2 is a cross-sectional elevational view of the device of FIG. 1 during a filling stroke.

FIGS. 1 and 2 show, in simplified cross-section, a known prior art gassing device for charging conventional aerosol containers. In FIG. 1, the gassing device is shown in a recovery position, and, in FIG. 2, in a filling position. The gassing device of FIGS. 1 and 2 generally corresponds to the apparatus disclosed in U.S. Pat. No. 3,013,591. Further details as to its construction and operation may be found therein.

Generally, the known gassing device includes a vertically stationary metering cylinder 10 and a filling head 12 which is vertically translatable with respect thereto. A spool 14, which has a throughgoing longitudinal channel, an enlarged upper sealing portion and a can adapter located at its bottom, interconnects metering cylinder 10 and filling head 12. Metering cylinder 10 encloses a ported internal sleeve 16, a ported retainer 18 and a sliding piston 20, guided by a rod 22 and having a protruding seal 24 on its bottom surface. Filling head 12 contains a poppet valve 26 which is actuated by raising filling head 12, for example, by raising an aerosol container C through use of an elevator table to engage and lift filling head 12 thereby opening poppet valve 26.

A conventional aerosol gassing device such as is shown in FIGS. 1 and 2 is substantially completely driven by the supply pressure of the propellant as follows. With the device in the recovery position shown in FIG. 1, the pressurized propellant is introduced into the interior of cylinder 10. The propellant flows through the ports provided at the top of sleeve 16 to act on the upper surface of piston 20. Similarly, propellant flows through peripheral ports provided on ported retainer 18 to act with equal pressure on the bottom surface of piston 20. However, it will be noted that rod 22 effectively reduces the upper surface of piston 20 which is exposed to the pressurized propellant. This produces an unbalanced upward force on piston 20 which drives it to an uppermost position as determined by an adjusting nut 28.

When a container C is elevated to a filling position as shown in FIG. 2, spool 14 is raised so that the enlarged seal mounted on its upper portion engages and seals against ported retainer 18 thereby isolating the propellant located beneath piston 20 from the propellant supply and placing this "metered charge" only in communication with filling head 12. Further elevation of container C opens poppet valve 26. Since the mixture located within inner sleeve 16 and immediately below piston 20 is now open to a lower pressure (i.e., the pressure in container C), a pressure imbalance results which drives piston 20 downward forcing the propellant below piston 20 and within sleeve 16 through filling head 12 and into container C.

At the bottom of the filling stroke, seal 24 contacts and seals off the opening in the top of spool 14. Piston 20 will remain in this downwardmost position, under container C is withdrawn.

As container C is lowered, poppet valve 26 first closes. Next, spool 14 is lowered, releasing the seal against ported retainer 18 and thereby allowing pressurized propellant to act on the lower face of piston 20. As noted above, this creates an imbalanced upward force which drives piston 20 to its uppermost position, ready to repeat the process with a new container.

Figure 3:
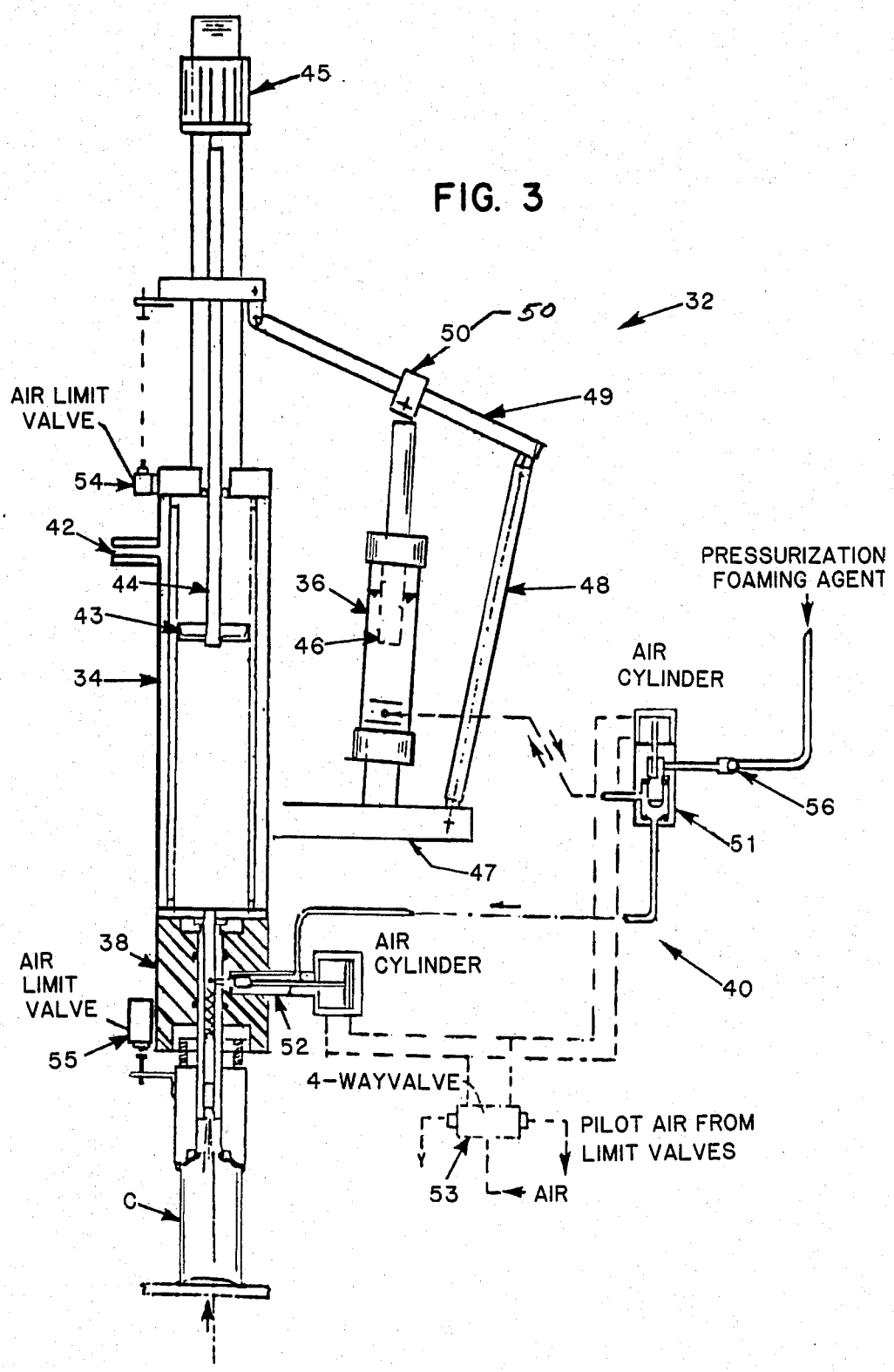
FIG. 3 is a schematic of a filling apparatus constructed according to the present invention.

We turn now to FIG. 3, showing schematically a filling apparatus 32 constructed in accordance with the present invention and generally including a first metering cylinder 34 for receiving a supply of concentrate (i.e., an aqueous surfactant and any additives thereto) and for discharging predetermined dosages of the concentrate, a second metering cylinder 36 for receiving a supply of a foaming agent and for discharging predetermined dosages of the foaming agent, a unique filling head 38 for receiving the dosages of concentrate and foaming agent, for intimately mixing these dosages and for ejecting the resultant mixture in a still liquid form into an appropriate container C, and an air actuated valve system 40 for controlling the flow of the foaming agent.

Metering cylinder 34 is a pressure actuated metering device constructed substantially as taught in U.S. Pat. No. 3,013,591 described above. However, metering cylinder 34 is here used to meter dosages of concentrate as opposed to just propellant.

Metering cylinders 34 and 36 are respectively supplied with pressurized concentrate and with pressurized foaming agent, each of which has been chilled to a temperature well below ambient. Since, in the preferred embodiment, the delayed foaming gel is exposed to ambient temperatures and pressures during the filling process, the respective ingredients are supplied to the filling head at near-freezing temperatures. The intimate mixing of the two ingredients results in a product which is unstable at normal ambient temperature and pressure. By chilling the two ingredients, however, the resultant mixture will remain stable for a relatively short period of time during which the container may be sealed. In the present preferred embodiment, the temperatures of the supplied concentrate and foaming agent are adjusted such that the resultant mixture is as cold as possible without freezing of the continuous (or liquid) phase of the emulsion. Such adjustment of temperature keeps the vapor pressure of the foaming agent sufficiently low for a relatively short period of time following mixing such that the foaming agent is maintained as a liquid rather than a gas in the emulsion. During this relatively short period of time, the container is sealed or capped (by methods well known in the art) such that equlibration to normal ambient temperature does not thereafter affect the nature of the sealed product.

However, the temperatures of the supplied concenterate and foaming agent can be varied over a wide range providing the resultant mixture is kept under sufficient pressure. Alternatively, the mixture could be injected directly through the valve of a "barrier" aerosol previously evacuated by vacuum. In such an embodiment, higher ingredient temperatures are possible.

In the present embodiment, the concentrate and foaming agent are chilled to between −1° C. and 10° C., even more preferably to between 0° C. and 3° C.

Cylinder 34 is supplied with pressurized concentrate which has been chilled to just above freezing (preferably in the range of from 0° C. to 3° C.) through a concentrate supply port 42. A piston 43 connected to a rod 44 reciprocates vertically within cylinder 34 delivering a predetermined dosage of concentrate to filling head 38 with each downward stroke and replenishing cylinder 34 with fresh concentrate through port 42 with each upward stroke. An adjustment mechanism 45 limits the uppermost stroke of piston 43 and rod 44 and thus determines the concentrate dosage.

Metering cylinder 36 is supplied with pressurized foaming agent which has been chilled to a temperature well below normal ambient temperature (e.g., preferably chilled to within the range of from about 0° C. to 3° C.) through air valve system 40. Cylinder 36 is preferably of the so-called "displacement type" variety of dispensers (well known in the art) in which reciprocation of a rod 46 causes intake or ejection of product from the cylinder. The bottom of cylinder 36 is pivotally mounted to a stationary bracket 47 cantilevered from cylinder 34.

Rod 46 of foaming agent cylinder 36 is actuated simultaneously with concentrate cylinder 34 and by power derived from the concentrate supply pressure through an adjustable linkage mechanism which includes two linkage bars 48 and 49. The lower end of bar 48 is pivotally joined to the outermost end of bracket 47 while its upper end is pivotally joined to one end of rod 49, the other end of rod 49 being pivotally attached to piston rod 44 of concentrate cylinder 34.

The top of displacement rod 46 of foaming agent cylinder 36 is pivotally attached to a sliding lockable clamp 50 which can be positioned and locked at various positions along the length of bar 49. It will be appreciated that, in the above-described construction, actuation of concentrate cylinder 34 will simultaneously cause actuation of foaming agent cylinder 36, and that the two cylinders will operate in tandem driven by the concentrate supply pressure. Moreover, whereas the dosage of concentrate delivered with each stroke is determined through adjustment mechanism 45, the dosage of foaming agent delivered can be adjusted through clamp 50. Moving clamp 50 leftwards on rod 49 lengthens the displacement stroke and therefore the foaming agent dosage, thus permitting adjustment of the mixture ratio.

Air actuated valve system 40 generally comprises a two position shuttle valve 51, a needle valve assembly 52, a four way valve controller 53 for actuating shuttle valve 51 and needle valve 52, a first air limit valve 54 mounted on cylinder 34, a second air limit valve 55 mounted on filling head 38, and a one way ball check valve 56 disposed upstream of shuttle valve 51.

Needle valve 52 opens during a filling stroke to allow passage of foaming agent to filling head 38, and closed during a recovery stroke to prevent product in filling head 38 from migrating into the foaming agent supply system. To this end, the opening and closing of needle valve 52 is triggered by second air limit valve 55 which has a detector unit and a stop mounted on two relatively movable components of filling head 38 as described hereinafter in more detail.

Shuttle valve 51 is translatable between two configurations to connect foaming agent cylinder 36 solely to filling head 14 during the filling stroke and solely to the foaming agent supply tank during the recovery stroke. To this end, shuttle valve 51 is controlled by air limit valve 54.

Figure 4:
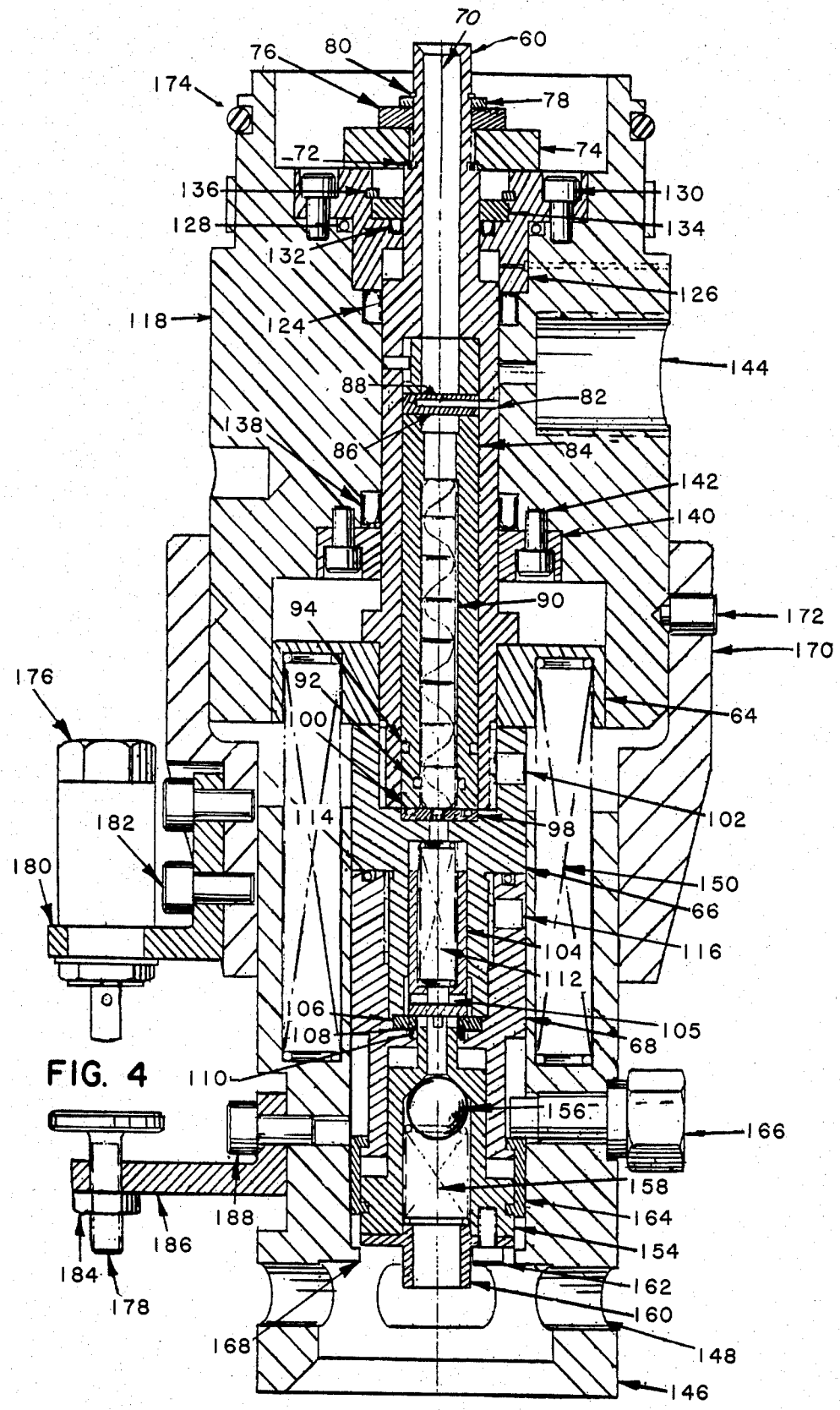
FIG. 4 is a detailed cross-sectional elevational view of a filling head constructed in accordance with the present invention.
Figure 5:
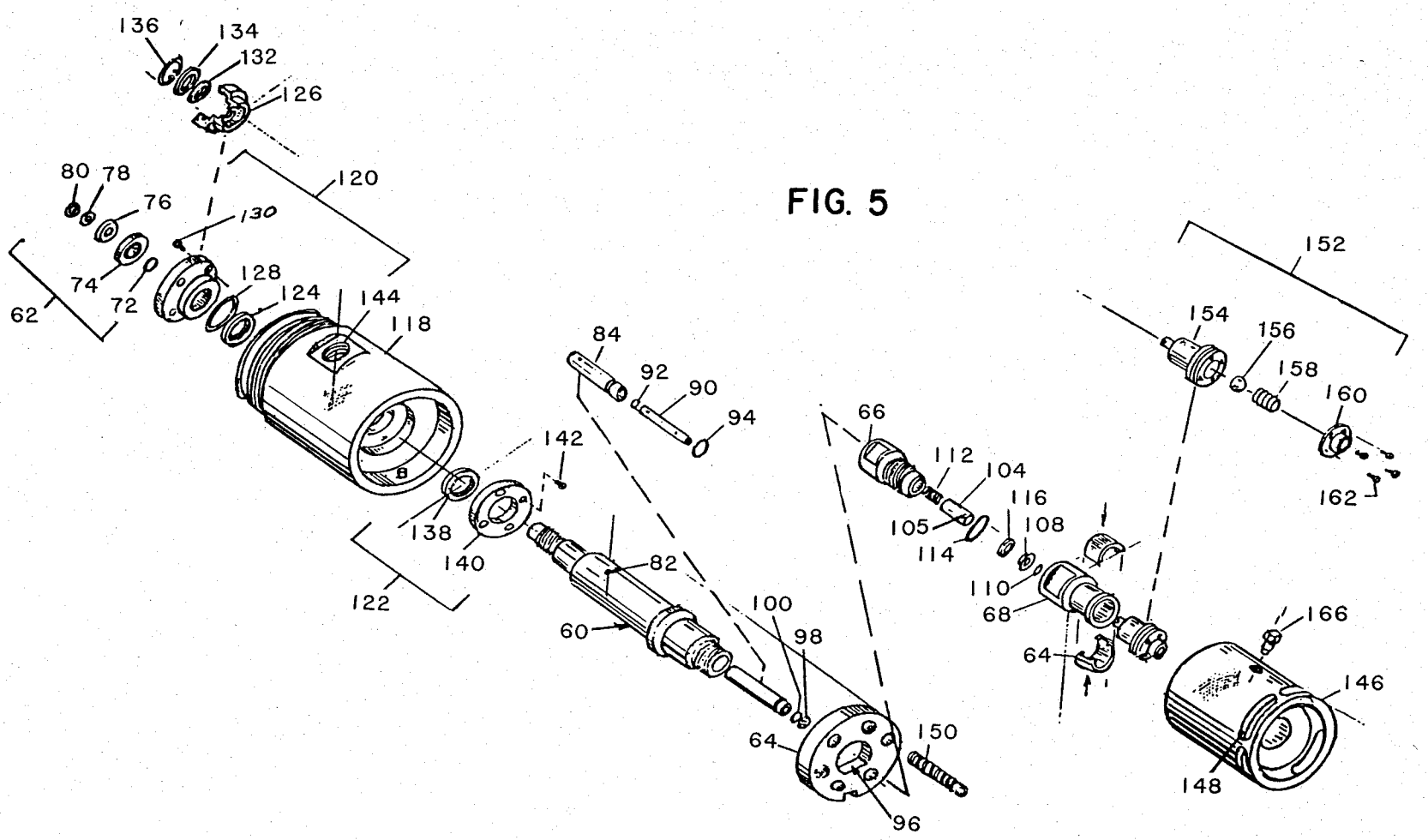
FIG. 5 is an exploded perspective view of the filling head of FIG. 3.

We refer most particularly now to FIGS. 4 and 5, FIG. 4 being a detailed cross-sectional view through filling head 38 of FIG. 3, and FIG. 5 being an exploded perspective view of the main components of filling head 38.

In general, filling head 38 includes a spool assembly which generally comprises a main spool piece 60 and, fixedly mounted thereon, a spool cap sealing assembly 62 (See FIG. 5.), a spool guide ring 64, a poppet cage 66, and a lower cage 68. These main components all attach fixedly together, as through mating threaded connections, to form a spool assembly which is a solid of revolution of the cross-sectional areas shown in FIG. 4. Each main component of the spool assembly has a throughgoing longitudinal passageway such that the spool assembly as a whole has a central passageway 70 into which concentrate is admitted and wherein, during the filling stroke, the concentrate is intimately mixed with the foaming agent prior to being expelled into the container in a still liquid form.

Spool cap sealing assembly 62 is fixedly mounted on main spool piece 60 by slipping its constituent components over the top end of main spool piece 60 in the following order:

(1) An O-ring 72.
(2) An annular spool cap 74 which is internally threaded to mate with corresponding threads on main spool piece 60, thereby compressing O-ring 72 against an annular shoulder formed on main spool piece 60
(3) A pliable (e.g., urethane) spool seal 76 of annular shape.
(4) A rigid (e.g., steel) annular spool seal retainer 78.
(5) A spring clip retaining ring 80 which snaps into a circumferential groove provided on main spool piece 60.

Main spool piece 60 is provided approximately one-third down its length with an intake orifice 82 and has an enlarged internal chamber for accepting a combined premix injector and static mixer shell 84. Housing 84 has fixedly mounted therein a transverse injector tube 86 (seen clearly in FIG. 4) with an upstream facing injector orifice 88. A static mixer assembly 90 (of a type well known in the art) is dimensioned to fit snugly within a counterbore provided within shell 84. A pliable O-ring 92 fits in a circular groove within shell 84 to provide a seal between same and mixer assembly 90. An additional O-ring 94 provides a seal between shell 84 and main spool piece 60.

Spool guide ring 64 slips over main spool piece and abuts an annular shoulder formed thereon. As shown in FIG. 5, spool guide ring 64 is provided with a locating flat 96 which matches a similar locating flat on main spool piece 60 to prevent rotation therebetween. Poppet cage 66 has an upper portion which is internally threaded to mate with external threads provided on the bottom of main spool piece 60 and a lower portion which is externally threaded to mate with similar threads provided on lower cage 68. Poppet cage 66 is also provided with a locating recess for positioning a four hole breaker plate 98 having four throughgoing holes equally spaced in its central region (not shown in more detail). Breaker plate 98 is so positioned that the four holes are positioned immediately beneath the outlet of static mixer assembly 90. A pliable O-ring 100 fits in a circular groove provided on the top of breaker plate 98 and surrounding the four holes to seal breaker plate 98 and mixer shell 84.

With poppet cage 66 threadingly mated to main spool piece 60, mixer shell 84, static mixer assembly 90 and breaker plate 98 are effectively locked into place in the interior of the spool assembly. Additionally, spool guide ring 64 is fixedly mounted thereon, being locked between the annular shoulder provided on main spool piece 60 and the upper surface of poppet cage 66. A set screw 102 prevents loosening due to vibration.

Poppet cage 66 has a longitudinal throughgoing passageway, the uppermost entrance to which surrounds the four holes provided in breaker plate 98. The passageway thereafter is enlarged to form a chamber wherein there is located a poppet 104. Lower cage 68 also has a central passageway the upper portion of which is enlarged to snugly accommodate a pliable washer-shaped poppet valve seal 106, along with the associated sealing components of a valve seal seat 108 (which is generally L-shaped in cross-section) and an O-ring 110 for preventing seepage past the poppet valve seal 106. A coal spring 112 is provided for biasing poppet 104 downwards against poppet valve seal 106.

Poppet 104 is a generally cup-shaped member having two transverse throughgoing channels 105 drilled at right angles to one another immediately above its solid bottom surface.

The above-mentioned components of poppet 104, seal 106, seal seat 108, O-ring 110 and spring 112 generally comprise a poppet valve assembly which is enclosed within the spool assembly by positioning these components within the recesses and chambers provided and then screwing poppet cage 66 and lower cage 68 together. An O-ring 114 is provided to insure a tight seal between the last two mentioned parts, and a set screw 116 prevents loosening due to vibration.

The above mentioned components 60 through 116 generally comprise the spool assembly which acts as a single rigid member, with the exception of poppet 104 and its associated spring 112 which shuttle between open and closed positions to control delivery of product as discussed more fully hereinafter.

The spool assembly (so-called because it resembles a spool with a narrow central spindle portion and larger end portions, spool cap sealing assembly 62 and spool guide ring 64) is slidingly mounted within a lower packing box assembly which generally comprises a lower packing box 118, an upper seal assembly 120 and a lower seal assembly 122, the two latter mentioned assemblies 120 and 122 being accommodated by specially configured recesses provided in the top and bottom surfaces of lower packing box 118. Lower packing box 118 contains a central longitudinal hole which slidingly supports the spindle portion of the spool assembly allowing it to shuttle between uppermost and lowermost positions. Sealing assemblies 120 and 122 serve to prevent leakage of product and entry of friction causing contaminants.

To this end, upper seal assembly 120 includes an annular upper spring-loaded seal 124 (for example, Part No. 304A-112G manufactured by the Bal-Seal Co. of Tustin, Calif.) which is held in place by an upper seal retainer 126. An O-ring 128 provides additional sealing action. Upper seal retainer 126 is attached to lower packing box 118 through the provision of four equally spaced screws 130, and is configured on its upper surface to accommodate the additional sealing elements of another spring loaded seal 132, a rigid (e.g., steel) seal backup ring 134 and a spring retaining ring 136 (e.g., a "circlip"), which engages an internal groove provided in upper seal retainer 126 to thereby hold seal 132 and backup ring 134 in place. Inasmuch as upper seal assembly 120 is exposed to the pressurized concentrate during operation, fairly elaborate sealing means are provided to prevent any seepage.

Lower seal assembly 122, on the other hand, mainly serves to exclude dirt and is of somewhat simpler design, consisting of another spring loaded seal 138 held in place by a lower seal retainer 140 secured to lower packing box 118 through the provision of four equally spaced screws 142.

The components of filling head 38 so far described may be assembled for operation by assembling all the above-described components with the exception of spool cap sealing assembly 62, inserting the spool assembly into lower packing box 118, and thereafter mounting spool cap sealing assembly 62 onto main spool piece 60. In the vertical operation position shown in FIG. 2, it will be seen that the spool assembly will then be able to shift relative to lower packing box 118 between an uppermost (or filling) position and a lowermost (or non-filling) position.

Lower packing box 118 is provided with a cylindrical recess on its lower surface in which spool guide ring 64 slidingly rides to help guide the mechanism and prevent "cocking" during this reciprocating action.

Lower packing box 118 is provided with a foaming agent injector port 144 running transversely through one of its walls and terminating adjacent main spool piece 60. In the non-filling position shown in FIG. 4, injector port 144 is longitudinally offset from the intake orifice 82 provided in main spool piece 60, thereby preventing flow of the foaming agent into the central passageway 70 of filling head 38. However, in the uppermost or filling position (shown in FIG. 7), injector port 144 and intake orifice 82 are aligned and the pressurized foaming agent is injected into the central passageway 70 of the filling head to there be mixed with the concentrate.

The spool assembly described above is shifted between its two extreme positions through the action of a locator sleeve 146 which is of generally cylindrical shape. The bottom opening of locator sleeve is appropriately configured to engage and position containers which are to be filled with the delayed foaming gel. Vent openings 148 are provided immediately adjacent its bottom opening to allow the escape of air as a container is filled and to accommodate any overflow.

the top wall of locator sleeve 146 is provided with six equally spaced drill holes to accommodate six coil springs 150, the other ends of which are positioned in six corresponding drill holes provided in the lower surface of spool guide ring 64. This biasing arrangement between the locator sleeve 146 an the spool assembly allows locator sleeve 146 to travel upward relative to the spool assembly thereby opening the poppet valve.

A ball housing assembly 152 serves to decelerate the concentrate/foaming agent mixture and to also provide an actuating mechanism for the poppet valve assembly described above. The ball housing assembly 152 generally includes a ball housing 154 having a throughgoing central passageway which opens into an enlarged chamber wherein there is disposed a deceleration ball 156, a coil spring 158 biasing ball 156 towards its uppermost position within ball housing 154 and a nozzle 160 secured to the bottom of ball housing 154 by four equally spaced screws 162.

The uppermost portion of ball housing 154 consists of a tube of relatively reduced transverse dimension which projects upward through poppet valve seal 106 to contact the bottom of poppet 104. The top of the tube on ball housing 154 is provided with four equally spaced notches 159.

The removable nozzle 160 allows assembly of the ball 156 and spring 158 and provides support for the bottom end of spring 158.

The spool assembly, locator sleeve 146 and ball housing assembly 152 are maintained in limited relatively movable relationship with respect to one another through the provision of a split ring 164 and a locking screw 166 which extends a short distance through the wall of locator sleeve 146. Each of the two essentially identical halves of split ring 164 is generally channel shaped in cross-section having upper and lower inwardly protruding leg portions. The upper leg portions extend over and are supported by an outwardly protruding lip provided on the bottom of lower cage 68 which, as noted above, is part of the essentially rigid spool assembly. The bottom leg portions of split ring 164 engage a circular groove surrounding ball housing 154. Locking screw 166 rests on the upper surface of split ring 164 thereby supporting locating sleeve 146 with respect thereto. The bottom of locator sleeve 146 has an inwardly projecting lip portion 168 which projects inward a sufficient distance to engage split ring 164 as the spool assembly moves to the uppermost or filling position. However, lip portion 168 does not project inward sufficiently to directly contact ball housing asembly 152, but only acts indirectly through split ring 164.

The final major component of filling head 14 is a generally barrel shaped outer sleeve 170 (shown only in FIG. 4) which is fixedly attached to lower packing box 118 through provision of three set screws 172 and extends therebelow to define a generally cylindrical cavity within which the upper portion of locator sleeve 146 may slidingly translate. In FIG. 4, outer sleeve 170, being of a general barrel shape, appears as two cross-sectional areas to the right and left of the filling head.

Further details of construction which are shown in FIG. 4 are an O-ring 174 for sealing the filling head 38 to the known metering cylinder 34 described above and an air limit valve 176 (such as a "Clippard" (TM) 3-way control valve) and an adjustable stop 178 therefor. Valve 176 is fixedly mounted on outer sleeve 170 by a bracket 180 secured with screws 182, while stop 178 (which is adjustable via a nut 184) is fixedly mounted to locator sleeve 146 by another bracket 186 secured by a screw 188. Valve 176 and stop 178 generally make up limit valve 55 shown in FIG. 3.

OPERATION

The detailed cross-sectional view of FIG. 4 should be studied in conjunction with the more simplified cross-sectional views of FIGS. 6 and 7 (showing, respectively, the non-filling and filling positions) as regards the below-described operation of the present invention filling head.

Figure 6:
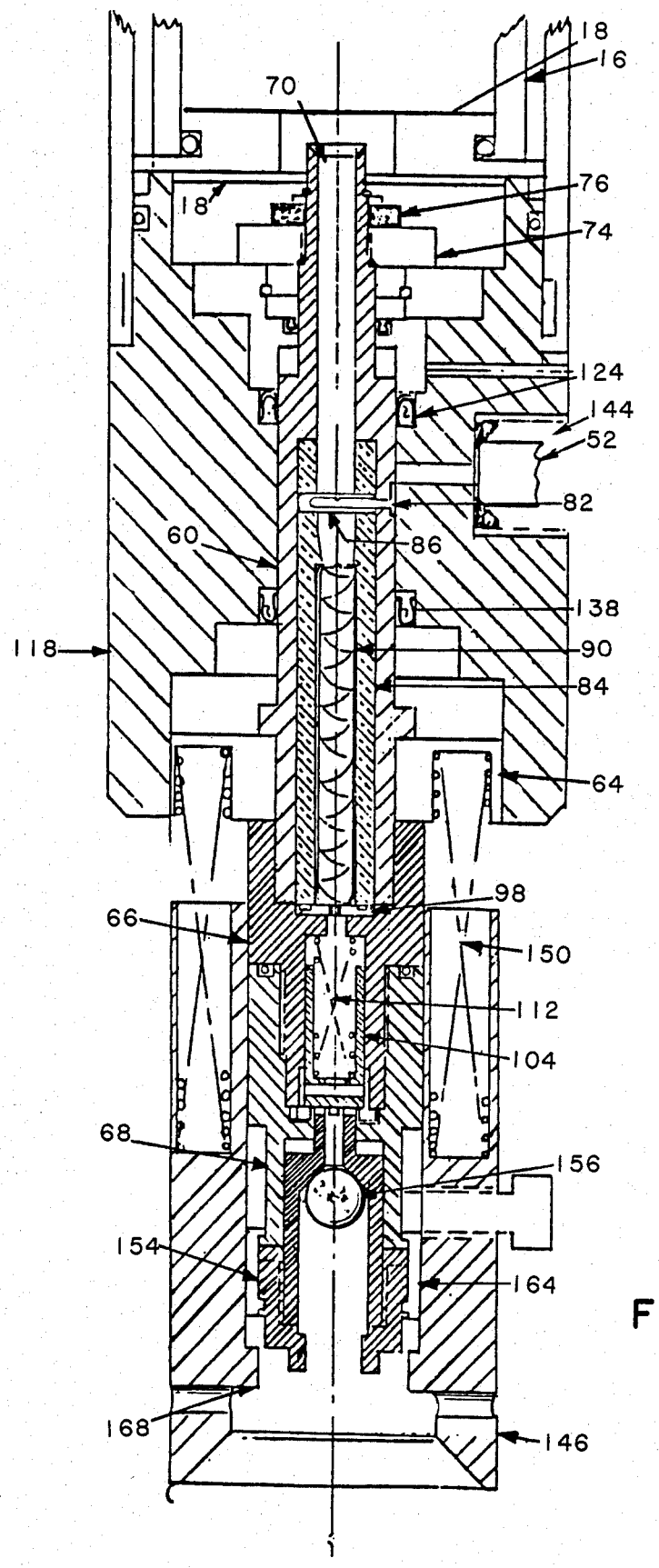
FIG. 6 is a simplified cross-sectional elevational view of the filling apparatus in a non-filling configuration.
Figure 7:
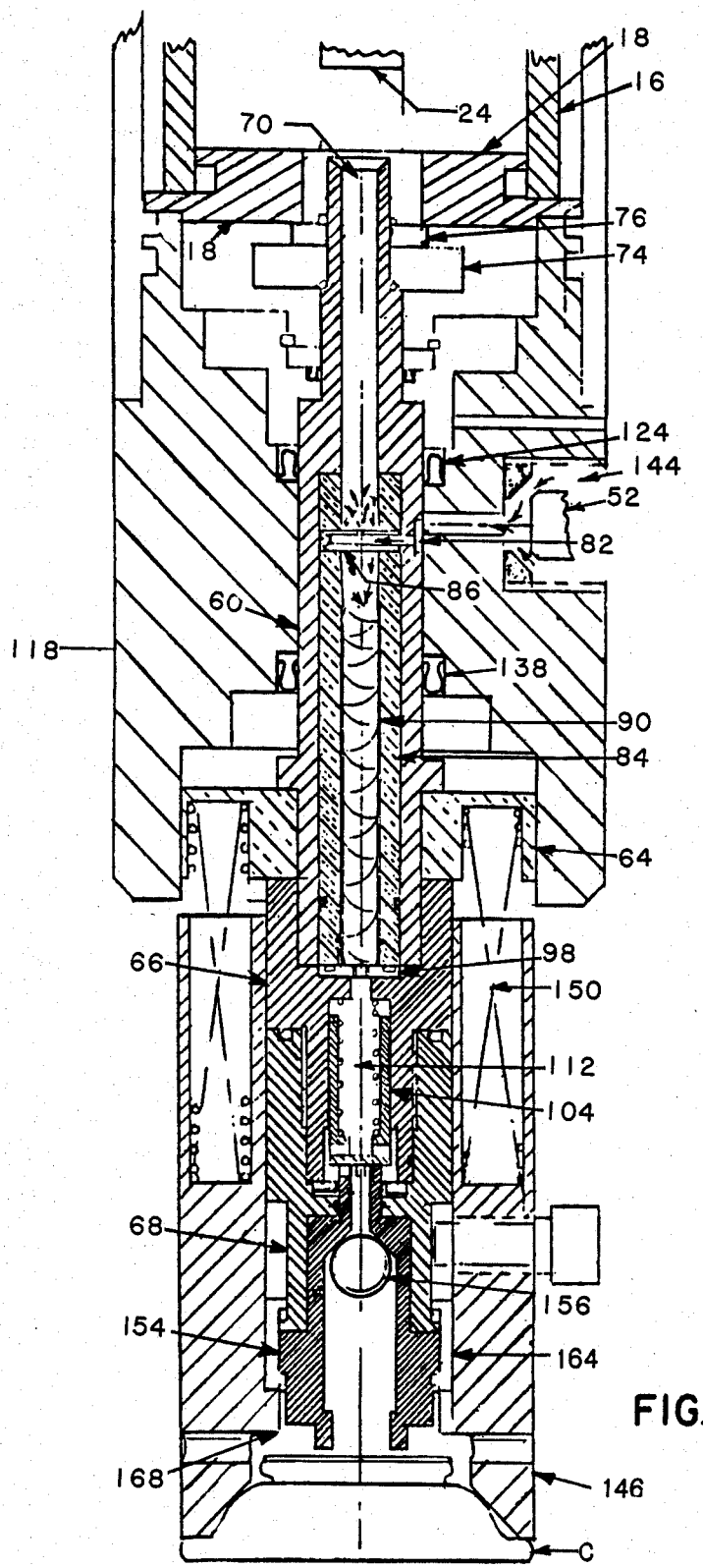
FIG. 7 is a simplified cross-sectional elevational view of the filling apparatus in a filling configuration.

Beginning the filling sequence with the non-filling position shown in FIGS. 4 and 6, in this position, the spool assembly is held at its lowermost resting position by gravity. Essentially, the entire mechanism hangs from lower packing box 118 and outer sleeve 170 which is fixedly attached to lower packing box 118, and spool cap sealing assembly 62 rests on the upper surface of upper seal assembly 120 thereby supporting the spool assembly in its lowermost position. Poppet 104 is biased downward against poppet valve seal 106, and thus the poppet valve assembly is in a closed position. The portion of the throughgoing passageway 70 located above the poppet valve assembly is here presumed to contain a concentrate/foaming agent mixture from an immediately preceding cycle, with unmixed concentrate existing in the portion of passageway 70 located a short distance above injector tube 86. The concentrate is in a pressurized state determined by the concentrate supply system.

The transition from the non-filling position may be best visualized in two steps: (1) translation of the spool assembly to its uppermost position followed by (2) opening of the poppet valve assembly.

An aerosol container C (FIG. 7) is now raised (e.g., by means of an elevator table) to engage the lower periphery of locator sleeve 146. Any initial contact shock is absorbed by springs 150. Continued elevation causes locator sleeve 146 to be upwardly displaced and, through springs 150 in contact with spool guide ring 64, exerts an upward force on the spool assembly to move it upwards.

As the spool assembly travels initially upwards, the ball cage assembly follows due to the action of split ring 164. The spool assembly reaches the uppermost position when spool cap sealing assembly 62 seals against the ported retainer 18 (See FIGS. 1 and 2.) provided in metering cylinder 34 discussed above. Additionally, as noted above, in this uppermost position, intake orifice 82 and injector port 144 are in matched relationship.

Still further elevation of locator sleeve 146 causes compression of springs 150 whereby sleeve 146 travels still further upwards relative to the spool assembly, ball housing assembly 152 and split ring 164, until the lip 168 provided on the lower inward periphery of sleeve 146 comes in contact with the bottom surface of split ring 164. It will be noted that the lower portion of lower cage 68 is of reduced outer diameter to provide clearance for locking screw 166 to translate upward relative thereto during this latter movement.

The aerosol container C is now raised further, whereby lip 168 forces ball housing 154 upwards, thereby lifting poppet 104 away from seal 106. Due to the imbalance of pressure caused by the opening of the poppet valve assembly, the metering cylinder 34 executes a downward filling stroke to force a predetermined dosage of concentrate into passageway 70. Simultaneously, needle valve 52 is opened and the foaming agent displacement cylinder 36, through its linkage to the metering cylinder, injects a desired amount of foaming agent through port 144, orifice 82 and upstream into the oncoming concentrate stream through injector orifice 88. Injecting the foaming agent in the upstream direction causes a premixing action which prevents a "channeling" effect. The filling stroke is best seen in FIG. 7.

The premixed concentrate/foaming agent is then forced through static mixer assembly 90 where it is intimately mixed and thereafter through breaker plate 98 where the mixture is sufficiently sheared to emulsify the foaming agent within the internal phase of the aqueous surfactant. The still liquid mixture traverses opened poppet 104 through holes 105 and enters ball housing 154 through notches 159, there encountering biased deceleration ball 156 which it forces somewhat downward. Ball 156 serves to smooth the transition from a narrower to a larger area of flow and thereby prevent the mixture from emerging as a high speed jet. The mixture is thereafter ejected in a still liquid form through nozzle 160 into the container C.

When piston 43 of concentrate metering cylinder 34 reaches the bottom of the filling stroke, the protruding seal 24 provided on its bottom face engages the top of the spool assembly to seal passageway 70. At this point, predetermined dosages of concentrate will have been intimately mixed and the resultant mixture ejected into the container C. Through the action of limit valve 54, needle valve 52 is now closed and shuttle valve 51 is configured such that foaming agent metering cylinder 36 is in fluid communication with only the supply of fresh foaming agent. The apparatus will remain so positioned until the container C is lowered.

Lowering container C allows sleeve 146 to drop to its lowest position, first closing the poppet valve assembly and thereafter lowering the spool assembly. As noted above, this breaks the seal between spool cap assembly 62 and the ported retainer 18 provided in concentrate metering cylinder 34, whereupon piston 43 is driven to its uppermost position by differential pressure. During the recovery stroke, fresh concentrate and foaming agent are drawn into the respective metering cylinders.

The container C is now, in a subsequent operating station, capped and sealed quickly enough to prevent any foaming of the gel. Of Course, where the filling is done through an already installed valve into an evacuated chamber, such a subsequent sealing operation is unnecessary.

While the present invention has been described by way of a particular preferred embodiment, various substitutions of equivalents may be effected without departing from the spirit or scope of the invention as set forth in the apended claims.

What is claimed as new and desired to be secured by letters patent of the United States is:

1. A method for forming and packaging, in a suitable container for the dispensing thereof, a delayed foaming gel, comprising the steps of:

(a) providing a stream of an aqueous surfactant;
(b) providing a stream of a foaming agent;
(c) providing a container filling head that has an outlet;
(d) coupling a conventional aerosol-type gel dispensing container to said outlet of said filling head;
(e) injecting said stream of aqueous surfactant into said filling head;
(f) injecting said stream of foaming agent into said filling head in a flow direction opposite to the flow direction of said stream of aqueous surfactant to provide a flowing stream of an intimate mixture of said aqueous surfactant and said foaming agent in said filling head;
(g) subjecting said flowing mixture stream to shearing action in said filling head sufficient to form a flowing stream of an emulsion of said foaming agent and said aqueous surfactant in said filling head;
(h) ejecting said flowing emulsion of said foaming agent and said aqueous surfactant in liquid form from said filling head directly into said container;
(i) sealing said container; and
(j) thereafter equilibrating said container and the mixture therein to normal ambient temperature thereby causing said mixture to form said delayed foaming gel in said container.

2. A method as in claim 1, and further including the steps of chilling said streams of said aqueous surfactant and said foaming agent to below ambient temperature prior to the intimate mixing thereof in said filling head.

3. A method as in claim 2, wherein the temperatures of said aqueous surfactant and foaming agent are in the range of from −1° C. to 10° C.

4. A method according to claim 3, wherein the temperatures of said aqueous surfactant and said foaming agent are between 0° C. and 3° C.

5. A method as in claim 1, and further including the step of intermittently pulsing said streams of aqueous surfactant and foaming agent to deliver consecutive dosages of said aqueous surfactant and said foaming agent to said filling head in a ratio determined to form said delayed foaming gel.

6. A method as in claim 1, wherein said step of mixing said streams comprises the step of injecting said foaming agent into said filling head for flow in an upstream direction into an oncoming flow of said aqueous surfactant, and said step of emulsifying said mixture in said filling head includes the step of passing said flowing mixture through a static mixer and shear means for shearing said mixture sufficiently to emulsify said foaming agent within said aqueous surfactant.

7. A method according to claim 6, wherein said shear means comprises a breaker plate.

8. A method as in claim 1, further comprising an initial step in mixing said aqueous surfactant with oil to form an aqueous surfactant and oil emulsion for injection into said filling head and intimate mixing with said foaming agent to form said flowing mixture of said aqueous surfactant and said foaming agent.

9. A process for forming and packaging, within a suitable container for the dispensing thereof, an unstable product produced by intimately mixing at least first and second ingredients, the resulting unstable product remaining stable following the mixing of said ingredients for a relativley short period of time under normal ambient conditions, said method comprising:

(a) providing a stream of said first ingredient;

(b) providing a stream of said second ingredient;

(c) injecting said stream of said first ingredient into a filling head in a first direction, injecting said stream of said second ingredient into said stream of said first ingredient in said filling head in a flow direction opposite to the flow direction of said stream of said first ingredient to form an intimate mixture of said first and second ingredients as a flowing liquid stream in said filling head;

(d) ejecting said flowing liquid stream from said filling head directly into said container; and (e) sealing said container prior to the elapse of said relatively short period of time.

10. A process as in claim 9, wherein said unstable product is a delayed foaming gel, said first ingredient is an aqueous surfactant and said second ingredient is a foaming agent, and wherein, following sealing of said container, said container is equilibrated to normal ambient temperature thereby causing said mixture to form said delayed foaming gel in said container.

* * * * *